United States Patent [19]

Schneider

[11] Patent Number: 4,716,636

[45] **Date of Patent: * Jan. 5, 1988**

[54] BURIAL VAULT LOWERING DEVICES

[76] Inventor: John C. Schneider, 404 E. 1st St., Huxley, Iowa 50124

[ * ] Notice: The portion of the term of this patent subsequent to Dec. 5, 2003 has been disclaimed.

[21] Appl. No.: 596,092

[22] Filed: Apr. 2, 1984

[51] Int. Cl.[4] ..... A61G 19/00

[52] U.S. Cl. ..... 27/32

[58] Field of Search ..... 27/32–34, 27/26

[56] References Cited

U.S. PATENT DOCUMENTS

| | | | |
|---|---|---|---|
| 659,751 | 10/1900 | Messler | 27/26 |
| 714,663 | 12/1902 | Brannock | 27/26 |
| 2,122,286 | 3/1938 | Haase | 27/32 |
| 2,130,056 | 9/1938 | Austin | 27/32 |
| 2,192,388 | 3/1940 | Schulz | 27/32 X |
| 2,218,286 | 10/1940 | Lampe | 27/32 X |
| 2,307,420 | 1/1943 | Mead | 27/32 |
| 2,537,812 | 1/1951 | Boehme | 27/33 X |
| 2,762,106 | 9/1956 | Wilkirson | 27/32 |
| 2,870,519 | 1/1959 | Yeazel | 27/32 |
| 3,364,536 | 1/1968 | Williams | 27/32 X |

FOREIGN PATENT DOCUMENTS

| | | | |
|---|---|---|---|
| 3145580 | 5/1983 | Fed. Rep. of Germany | 27/32 |
| 49640 | 5/1939 | France | 27/32 |

*Primary Examiner*—James R. Feyrer

*Attorney, Agent, or Firm*—Zarley McKee, Thomte, Voorhees & Sease

[57] ABSTRACT

This invention is an apparatus for the handling and setting of all commonly used burial vaults and vault covers.

Specifically this device quickly, efficiently and safely allows burial vaults to be held above the surface of the ground in a position that facilitates the lowering of a casket therein; and allows the vault cover to be properly displayed during graveside services and to be properly sealed on the vault and for the assembled vault unit to be lowered into the grave.

1 Claim, 8 Drawing Figures

4 Sheets - Sheet 2

BURIAL VAULT LOWERING DEVICES

BACKGROUND OF THE INVENTION

Heretofore burial vault lowering devices were heavy, bulky and inefficient as well as unsafe, often allowing the vault and casket to drop unrestrained to the bottom of the grave. In addition the vault lid on existing devices was not presented in a satisfactory manner and was difficult to assemble and release the clamps on said devices.

Accordingly an object of the present invention is to provide a new and improved, simple, safe and inexpensive burial vault lowering device and cover-handling apparatus for suspending burial vaults above the surface of a grave; and to efficiently allow one man to set-up and operate said device.

A further object of this invention is to provide a new and improved burial vault cover handling and clamping device which is more quickly attached than previous devices, and which properly holds and displays the vault cover and any engraving thereon.

Still another object of the invention is to provide a device which may be assembled and operated between adjacent tombstones where existing devices do not adequately function due to their size and bulkiness.

SUMMARY OF THE INVENTION

This invention consists of a set of compact, connected, gear driven devices and a set of lid clamp apparatus and rails; whereby a concrete burial vault may be suspended in the grave and the vault lid properly displayed and thereafter rolled over and set on the suspended vault and sealed thereon, after which the entire sealed unit may be then quickly and easily lowered into the grave by means of the gear driven apparatus and a set of flexible connectors or cables.

DETAILED DESCRIPTION OF THE INVENTION

A typical assembly of the new vault lowering device is shown and illustrated in FIGS. 1 to 8 inclusive of the drawings.

Figure 1:
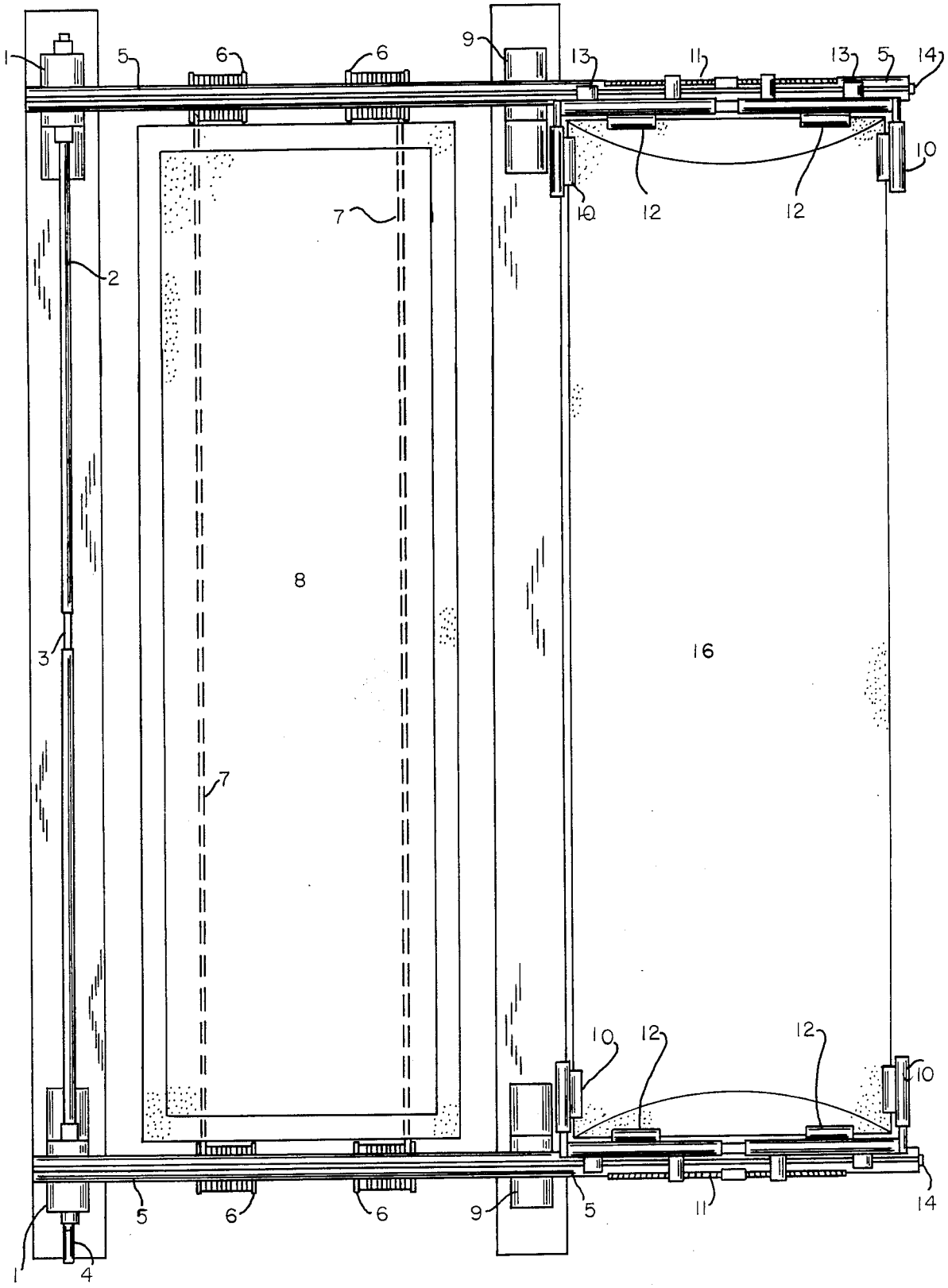
FIG. 1 is a plan view showing the new vault lowering device in the position of use at a grave opening.
Figure 4:
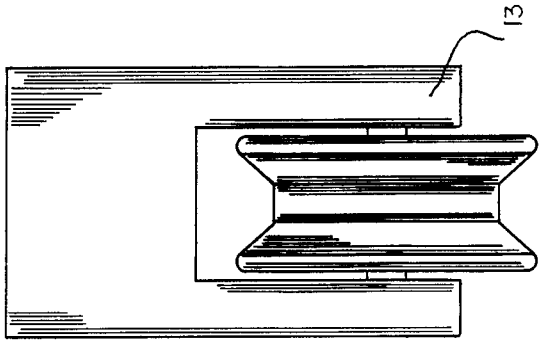
FIG. 4 is a detail view of the construction of one of the guide wheels on the lid clamps.
Figure 2:
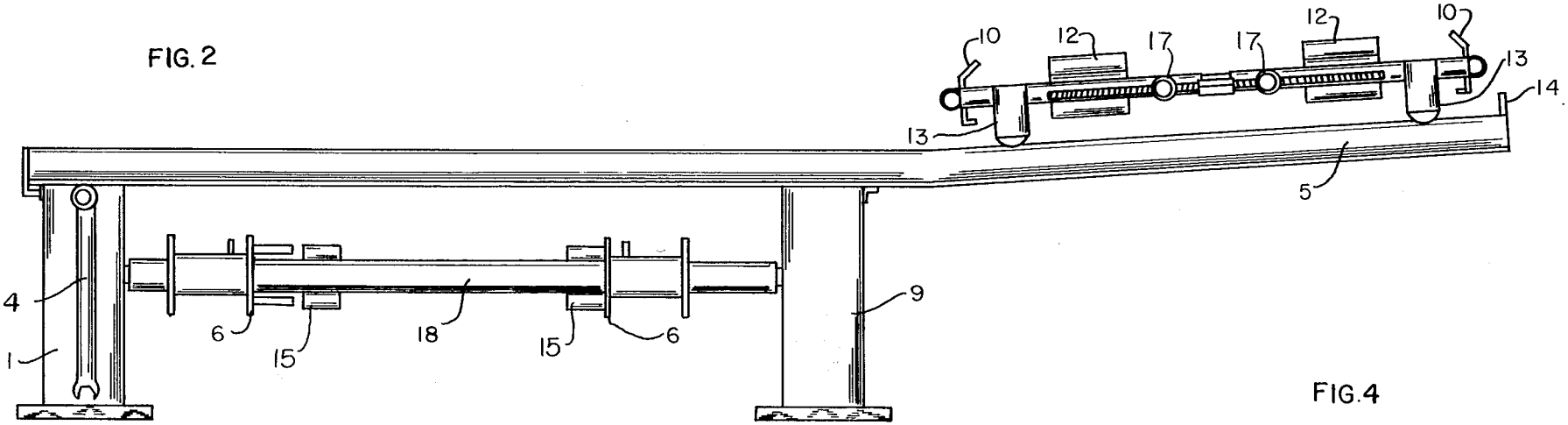
FIG. 2 is a side view in elevation of the device when assembled.

The new apparatus is assembled and shown in position at a grave opening in FIG. 1 and comprises two pairs of pedestals 1 and 9. The two geared boxes 1, are connected with a rotatable shaft 2, which is adjustable at 3, for any length burial vault. Each geared box or pedestal 1, is also connected to a non-geared pedestal 9, by means of a rotatable shaft 18. The pair of movable spools 6, which ride on each shaft 18, and upon which the flexible cable 7, is attached and wound are locked to shaft 18, by means of the locks or stops 15.

Both shafts 2 and 18, are controlled by the crank handle 4, which may be operated at either end of the apparatus on either pedestal 1.

Figure 3:
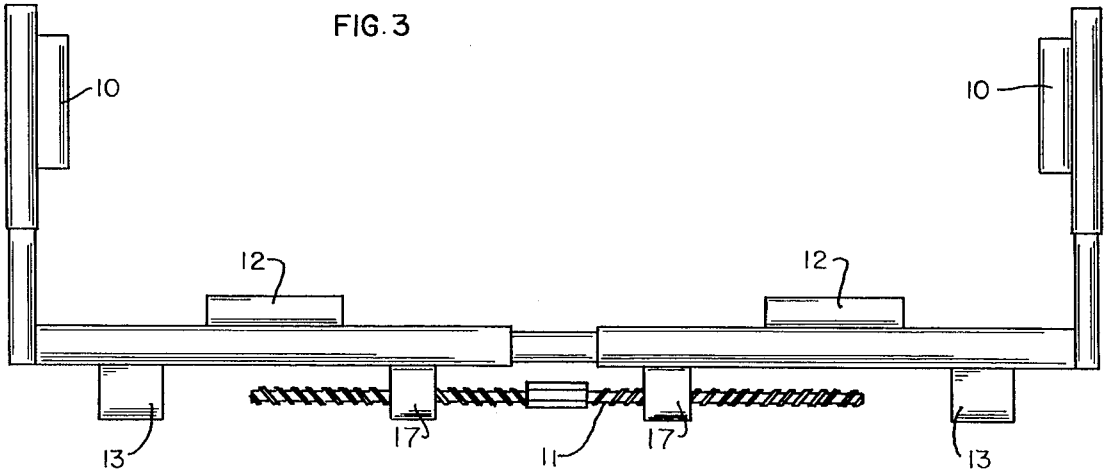
FIG. 3 is a detail view showing part of the lid clamp construction for holding the burial vault lid or cover.
Figure 5:
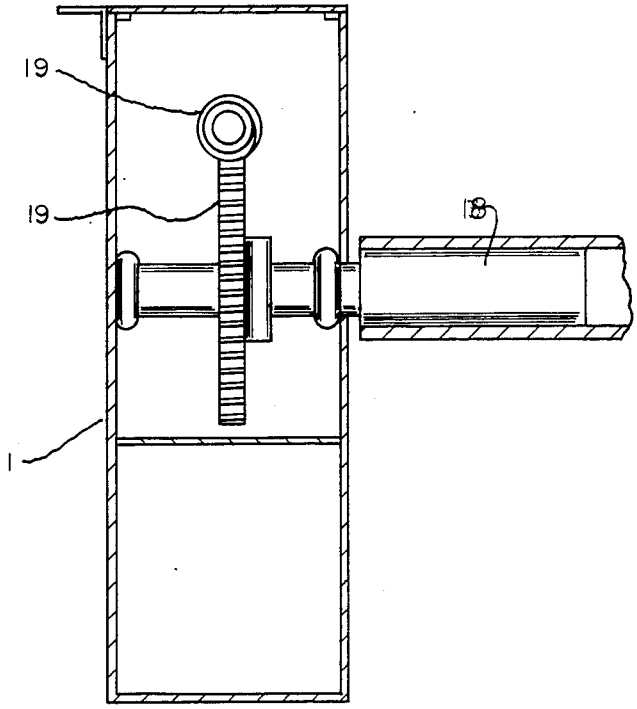
FIG. 5 is a front detail, sectional view of the geared box or pedestal construction.
Figure 6:
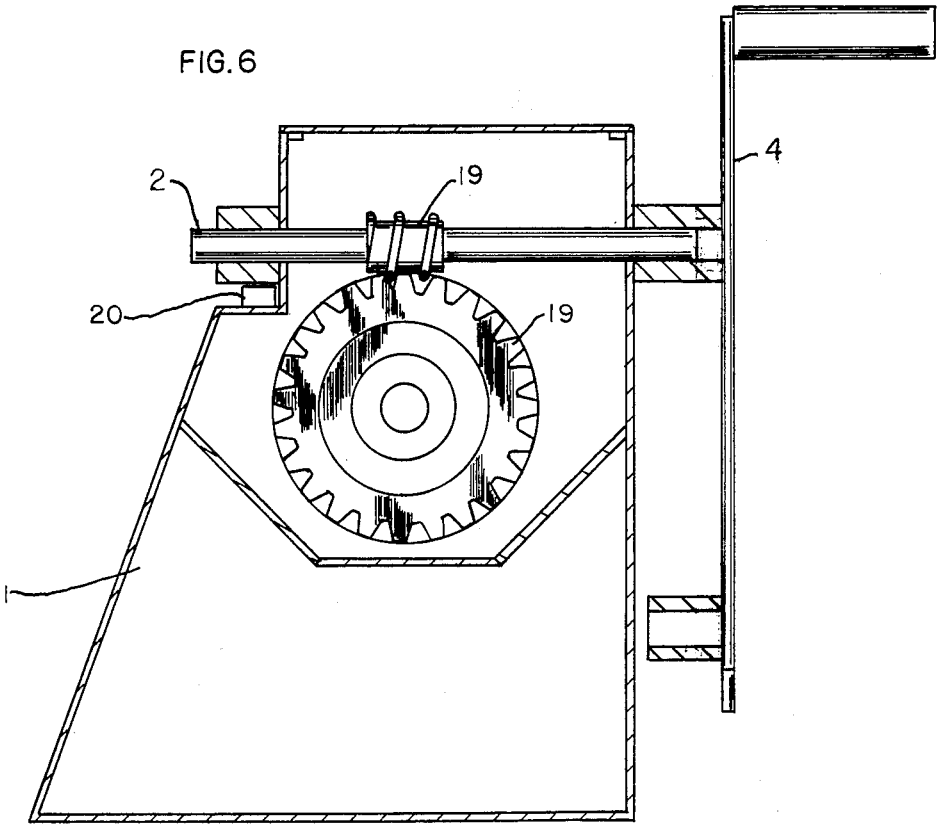
FIG. 6 is a side, detail, sectional view of one of the geared box or pedestal construction.
Figure 7:
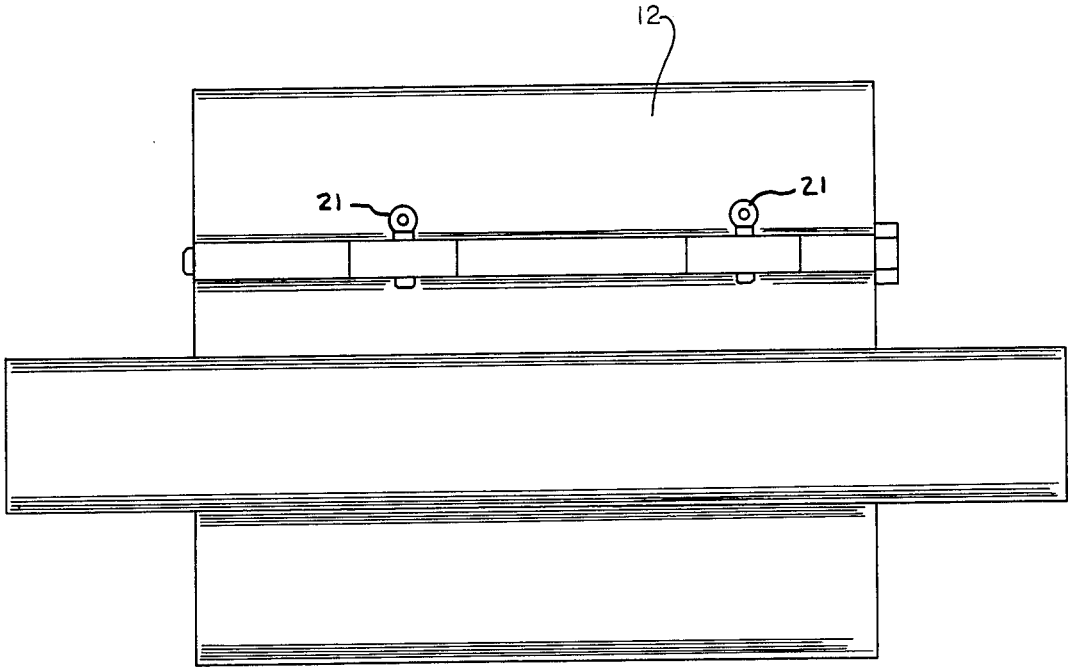
FIG. 7 is a detail view of the construction of the adjustable end clamp portion of the lid clamp.
Figure 8:
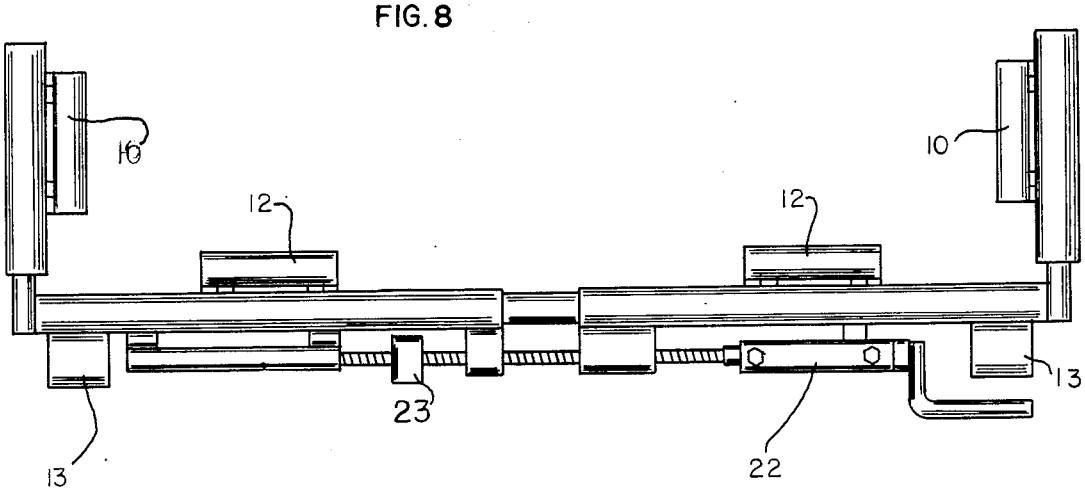
FIG. 8 is a detail view of the construction of one of the quick, adjustable lid clamps.

The vault lid 16 is supported by a pair of lid clamps as shown in either FIG. 3 or 8, said clamps consisting of a pair of side clamps 10, mounted on a supporting, adjustable frame said clamps 10 supporting the outer edges of the vault lid 16 and a pair of end clamps 12, which are adjustable to any currently utilized vault lid style, by means of the hinged portion of end clamp 12 and the locking pins 21.

It will thus be seen from the foregoing description, considered in conjunction with the accompanying drawings, that the present invention provides a novel apparatus for handling concrete burial vaults and covers or lids at the grave site and for the lowering and raising of said vault with or without the casket therein, and thus has desirable advantages and characteristics and accomplishes its intended objects including those heretofore pointed out and others which are inherent in the invention.

I claim:

1. An improvement in a burial vault and a vault lid handling apparatus having a supporting frame, a vault lid having a first end, a second end opposite said first end, a first elongated side and a second elongated side opposite said first elongated side, a pair of holding means extending transversely around said first end and said second opposite end of said vault lid, a pair of wheels on each of said pair of said holding means, a first guide rail located at said first opposite end of said vault lid, a second guide rail located at said second opposite end of said vault lid, one of said pair of wheels engaging said first guide rail; one of said pair of wheels engaging said second guide rail; said first and second guide rails resting on said supporting frame, said improvement comprising:

each of said first and second guide rails comprising a first portion and second portion, said first portions being placed over said supporting frame, said second portions extending from said first portions so that each of said second portions of said guide rails extend parallel to each other in the same direction; and said second portions being angled upwardly from said first portions at an angle less than 180° whereby said vault lid can be rotatably guided along said guide rails from said second portions to said first portions and said vault lid placed over said vault and whereby viewing of said vault lid while at said angle is facilitated.

* * * * *